US005645323A

United States Patent [19]

Beach

[11] Patent Number: 5,645,323

[45] Date of Patent: Jul. 8, 1997

[54] CONCAVE CUTTER BIT WITH SACRIFICIAL CONSTRAINT

[75] Inventor: Wayne H. Beach, Roaring Spring, Pa.

[73] Assignee: Kennametal Inc., Latrobe, Pa.

[21] Appl. No.: 570,310

[22] Filed: Dec. 11, 1995

[51] Int. Cl.[6] ..... E21C 35/183

[52] U.S. Cl. ..... 299/111; 299/113

[58] Field of Search ..... 299/110, 111, 299/113; 175/402, 403, 428, 432, 435

[56] References Cited

U.S. PATENT DOCUMENTS

| | | | |
|---|---|---|---|
| 3,519,309 | 7/1970 | Engle et al. | 299/107 |
| 3,752,515 | 8/1973 | Oaks et al. | 403/344 |
| 3,791,465 | 2/1974 | Metge | 175/373 |
| 4,222,446 | 9/1980 | Vasek | 299/110 |
| 4,478,298 | 10/1984 | Hake et al. | 175/432 |
| 4,725,098 | 2/1988 | Beach | 299/105 |
| 5,007,685 | 4/1991 | Beach et al. | 299/85.2 |
| 5,078,219 | 1/1992 | Morrell et al. | 299/111 |
| 5,135,035 | 8/1992 | Mills | 144/241 |
| 5,333,938 | 8/1994 | Gale | 299/106 |
| 5,417,475 | 5/1995 | Graham et al. | 299/105 |
| 5,456,522 | 10/1995 | Beach | 299/113 |

FOREIGN PATENT DOCUMENTS

| | | | |
|---|---|---|---|
| 1029841 | 7/1983 | Russian Federation . | |
| 1686154 | 10/1991 | U.S.S.R. | 299/112 |
| 1112446 | 5/1968 | United Kingdom | 299/113 |
| 1284539 | 8/1972 | United Kingdom . | |
| 4027027 | 11/1994 | WIPO | 299/111 |

OTHER PUBLICATIONS

Properties and Proven Uses of Kennametal Hard Carbide Alloys, p. 43, Copyright 1972.

Brazing Manual, American Welding Society, 1963, pp. 232–236.

Designing with Kennametal, Kennametal Catalog A80–184(10)FO.

*Primary Examiner*—David J. Bagnell
*Attorney, Agent, or Firm*—Stanislav Antolin

[57] ABSTRACT

An article comprised of a first material and at least one additional material incorporates a sacrificial constraint. For example, a cutter bit has a bit body that contains a concavity and a sacrificial constraint in a axially first end. A cutter insert or a plurality of cutter inserts are brazed to the bit body at the periphery and in an annular channel or pocket defined by a first surface at the periphery of the concavity, a second surface radially outward form the first surface and radially inward from a sacrificial constraint that extends radially outward at the open end of the concavity. The sacrificial constraint may be removed from the article either prior to use by, for example, machining, or during use by, for example, attrition.

22 Claims, 2 Drawing Sheets

CONCAVE CUTTER BIT WITH SACRIFICIAL CONSTRAINT

BACKGROUND

The present invention relates to an article that combines by, for example, soldering or brazing, a first material and at least one additional material, at least a portion of which comprises a sacrificial constraint. Preferably, these two materials have substantially different coefficients of thermal expansion (CTE). More preferably, the first material includes at least one cemented carbide and the at least one additional material having a substantially different CTE than the cemented carbide functions as the sacrificial constraint. The sacrificial constraint facilitates the fabrication of the article with substantially fewer quality control rejections and fewer failures which can be premature to provide a longer, and more consistent useful life to the article as compared to the prior art articles designed for the same use. More particularly, the present invention relates to a cutter bit for use in conjunction with excavation equipment. Even more particularly, the invention relates to a concave cutter bit, preferably rotatable, for use in conjunction with excavation equipment such as, for example, a longwall shearer, a continuous mining machine, a trencher, a road milling machine, an auger, and a saw.

Some conventional cutter bits used for excavation equipment use a single cutting element at a forward end. In this particular application, it is only this single cutting element that forms the effective cutting element of the cutter bit that impinges upon and cuts or fractures the substrate such as, for example, earth strata. The balance of the forward end of the cutter bit pushes fractured or cut material out of the path of the cutter bit.

Another style of cutter bit for use with excavation equipment is a concave cutter bit. The typical concave cutter bit has an enlarged diameter portion, which contains a concavity, at the forward end. A cutter element of hard material such as, for example, cemented tungsten carbide, surrounds the outer periphery of the concavity so that the cutter element presents a generally circular or ring-like shape. One example of a concave cutter bit is illustrated by U.S. Pat. No. 5,078,219 to Morrell et al. Another example of such a cutter bit is shown by U.S. Pat. No. 5,333,938 to Gale.

The cutter element can take the form of a single piece ring such as is shown by Morrell et al. Typically, the cutter element is made from cobalt-cemented tungsten carbide and the bit body is made from steel. The cutter element is secured to the steel bit body by brazing so that, at a minimum, there is a braze joint between the bottom surface of the carbide cutter element and the surface of the cutter bit body.

Carbides such as cobalt-cemented tungsten carbide have coefficients of thermal expansion that are approximately one-half to one-third that of steel. This difference in thermal expansion results in contracting at different rates upon cooling after a brazing operation. This difference in contraction can create stresses in the steel bit body, the cemented tungsten carbide cutter element, or the braze joint, or any combination of the preceding. In turn these stresses can produce cracks in the steel bit body, the cemented tungsten carbide cutter element, or the braze joint, or any combination of the preceding.

Inferior quality such as the existence of cracks in the steel bit body, the cemented tungsten carbide cutter element, or the braze joint, or any combination of the preceding, can cause the bit to be discarded as scrap. The existence of cracks or brazing stresses also can eventually lead to the premature failure of the concave cutter bit during use. It is apparent that the inability of the cutter bit to either pass quality control examination or function well by failing prematurely in the field is undesirable.

The cutter elements can also take the form of a plurality of segments positioned adjacent to one another in an end-to-end relationship to form a complete ring. It has been found, however, that the presence of cracks and braze stresses are not reduced by the use of a plurality of cutter insert segments in comparison to a cutter bit with a single piece ring-shaped cutter element. For those cutter bits where the cutter element comprises a plurality of segments, each segment is positioned with its end surfaces near, but slightly spaced apart from, the corresponding end surface of the adjacent cutter element. In the past, the distance of the spacing has been about 0.5 mm (0.020 inches).

During brazing, braze alloy flows between the opposite ends of adjacent cutter element segments to form a continuous volume of braze alloy between the opposite end surfaces of the adjacent cutter element segments. A volume of braze alloy also exists between each one of the cemented tungsten carbide cutter element segments and the steel cutter bit body.

Upon initial cooling after the brazing operation, the braze joint between the opposite end surfaces of adjacent cutter element segments solidifies as does the braze joint between the cutter element segments and the cutter bit body. At this point, however, the steel cutter bit body and the cutter element segments must still cool to room temperature.

As the cutter bit and cutter element segments continue to cool and contract, the difference in the rate of contraction between the steel bit body and the cutter element segments, which now behave as if they were one piece, creates stresses in the steel bit body, braze, and the cutter element segments. The stresses can become so great that some of the cutter element segments or braze, or both, crack.

It thus becomes apparent that the problems associated with brazing stresses, braze joint cracks, and cutter element segments cracks exist for concave cutter bits having either a single piece ring-shaped cutter element or a cutter element comprising a plurality of segments where a continuous braze joint forms between the opposing end surfaces of the adjacent segments.

Thus, it would be desirable to provide an improved concave cutter bit that does not experience, or at least has reduced, stresses in the steel bit body, the cutter elements, or the braze joint, preferably a combination of the preceding. As a consequence, such a concave cutter bit would experience less quality control rejections, as well as fewer premature failures so as to provide a longer and more consistent useful life.

One approach to addressing the above described difficulties is presented in commonly owned U.S. Pat. No. 5,456,522 issued in the name of Beach relating to a concave cutter bit which has a bit body that contains a concavity in an axially forward end. A plurality of cutter inserts are brazed to the bit body at the periphery of the open end of the concavity. Cutter inserts are spaced-apart in such a fashion so that a gap exists between adjacent cutter inserts that is of sufficient size to prevent the formation of a continuous braze joint between any adjacent cutter inserts.

Another novel and different approach comprises the present invention.

SUMMARY

An embodiment of the present invention is directed to an article that combines by, for example, soldering or brazing, a first material and at least one additional material, at least a portion of which comprises a sacrificial constraint. Preferably, the at least two materials have substantially different coefficients of thermal expansion (CTE). More preferably, the first material includes at least one cemented carbide and the at least one additional material having a substantially different CTE than the cemented carbide. At least a portion of the sacrificial constraint functions as the sacrificial constraint. The sacrificial constraint facilitates the fabrication of an article having substantially fewer quality control rejections and fewer failures which can be premature to provide a longer, and more consistent useful life to the article as compared to the prior art articles designed for the same use. The sacrificial constraint also can be intentionally removed from the article either prior to use by, for example, machining, or during use by, for example, attrition.

The article comprises, consists essentially of, or consists of a first material and at least one additional material. The additional material(s) can be formed to have a first end, a second end, the second end opposite the first end, a sacrificial constraint which extends radially outward at the first end, an annular channel or pocket defined by a first surface at an inner periphery, a second surface radially outward form the first surface and radially inward from the sacrificial constraint, and a transverse surface extending therebetween; and an insert of the first material or a plurality of inserts of the first material secured by a solder or braze alloy to the body within the annular channel or pocket.

In embodiment of the present invention, the sacrificial constraint can be used in connection with conical bit such as that disclosed in U.S. Pat. No. 4,725,098 issued in the name of Beach. In such an example, the hard facing material might be replaced by, for example, an annular ring or collar which fits into a annular groove or channel define by an extended portion which is the sacrificial constraint. The sacrificial constraint can either be removed prior to use or wear during use to exposed the annular ring or collar which imparts superior wear resistance to periphery of the conical bit.

In another embodiment of the present invention, the sacrificial constraint can be used in connection with conical cutter bit such as that disclosed in U.S. Pat. No. 5,417,475 issued in the name of Graham et al. In such an example, the retaining member might be placed in, for example, an annular ring or collar which fits into a annular groove or channel define by a sacrificial constraint. The sacrificial constraint can either be removed prior to use or wear during use to exposed the annular ring or collar which imparts superior wear resistance to periphery of the conical bit by reducing wear around an inner insert.

Yet, another embodiment of the present invention is directed to a concave cutter bit that experiences substantially fewer quality control rejections, fewer premature failures to provide a longer, and more consistent useful life. The concave cutter bit comprises, consists essentially of, or consists of a bit body having a first end, a second end, the second end opposite the first end, a concavity in the first end, a radially outwardly extended portion at the first end, an annular annulus channel or pocket defined by a first surface at the periphery of the concavity, a second surface radially outward form the first surface and radially inward from a sacrificial constraint that extends radially outward at the first end, and a transverse surface extending therebetween; and a cutter insert or a plurality of cutter inserts secured by a braze alloy to the bit body at the periphery of the concavity and within the annular channel or pocket.

The improved concave cutter bit can be used in conjunction with excavation equipment such as, for example, a longwall shearer, a continuous mining machine, a trencher, an auger, a road milling machine, and a saw wherein the cutter bit has reduced or no brazing stresses.

In one form of the invention, a rotatable cutter bit comprises, consists essentially of, or consists of a bit body having opposite first and second ends and an open-ended concavity in the first end. The first end of the body is enlarged to accommodate an annular channel or pocket away from the periphery at open-ended concavity and for receiving a cutter insert or a plurality of cutter inserts. A cutter insert or plurality of cutter inserts are secured within the annular channel or pocket with a braze alloy. A cutter insert or a plurality of cutter inserts is sized so that after brazing and upon cooling both the braze joint and the cutter insert or the plurality of cutter inserts within the annular channel or pocket are constrained in residual compressive stress by the sacrificial constraint or the radially extended peripheral material of the bit body defining the annular channel or pocket at the open-end of the concavity. The cutter bit with the cutter bit body can then be heated, quenched and tempered to harden the steel to a hardness from at least about 40 and preferably up to about 42 Rockwell "C". The heat treatment also coincidentally anneals the braze alloy, the steel, or the cutter insert or the plurality of cutter inserts to reduce or relieve the residual stresses.

In another form of the invention, a cutter bit-block assembly comprises, consists essentially of, or consists of a block containing a bore and a cutter bit with a bit body. The bit body includes opposite first and second ends and an open-ended concavity in the first end. The first end of the body is enlarged to accommodate an annular channel or pocket away from the periphery at open-ended concavity for receiving a cutter insert or a plurality of cutter inserts. The bit body has a retainer that engages the bore of the block to retain the cutter bit within the block. The first end of the body is enlarged to accommodate a groove away from the periphery at open-ended concavity for receiving a cutter insert or a plurality of cutter inserts. A cutter insert or plurality of cutter inserts are secured within the groove by brazing to the bit body at the groove of the open end of the concavity. A cutter insert or a plurality of cutter inserts is sized so that after brazing and upon cooling both the braze joint and the cutter insert or the plurality of cutter inserts with the groove are constrained in a residual compressive stress by the sacrificial constraint (peripheral material) of the bit body defining the groove at the open-end of the concavity. The cutter bit with the cutter bit body can then be heated, quenched and tempered to harden the steel to a hardness from at least about 40 and preferably up to about 42 Rockwell "C". The heat treatment coincidentally anneals the braze alloy, the steel, or the cutter insert or the plurality of cutter inserts to reduce or relieve the residual stresses.

The invention illustratively disclosed herein can suitably be practiced in the absence of any element, step, component or ingredient which is not specifically disclosed herein.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
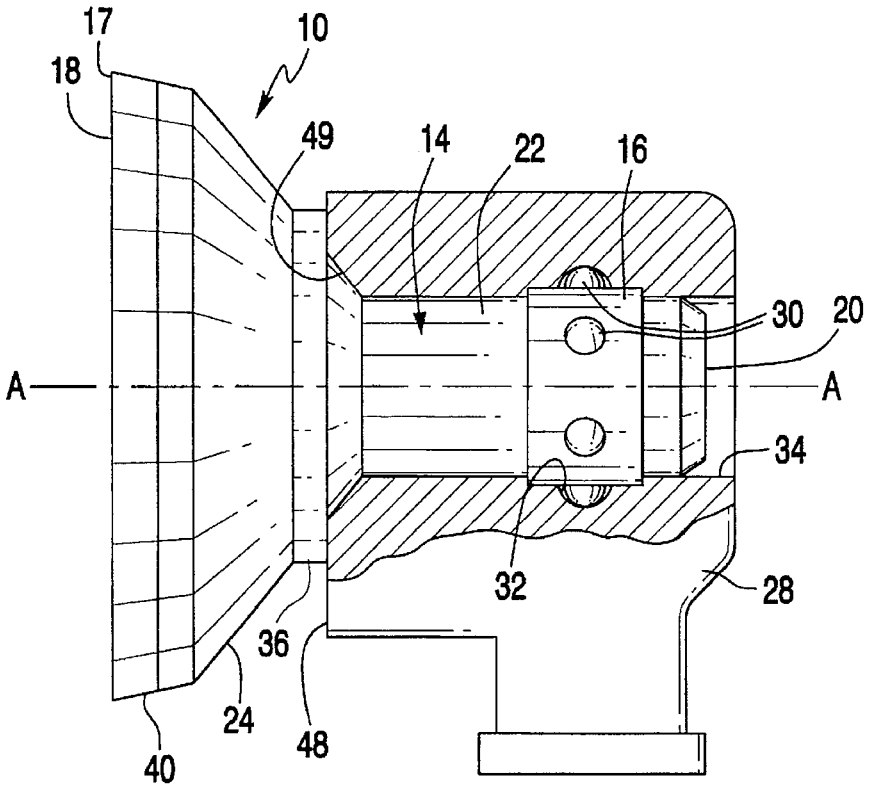
FIG. 1 is a side view of a specific embodiment of the concave cutter bit of the invention with the cutter bit attached to a block wherein the block is shown in partial cross-section so as to illustrate the connection between the cutter bit and the block.
Figure 2:
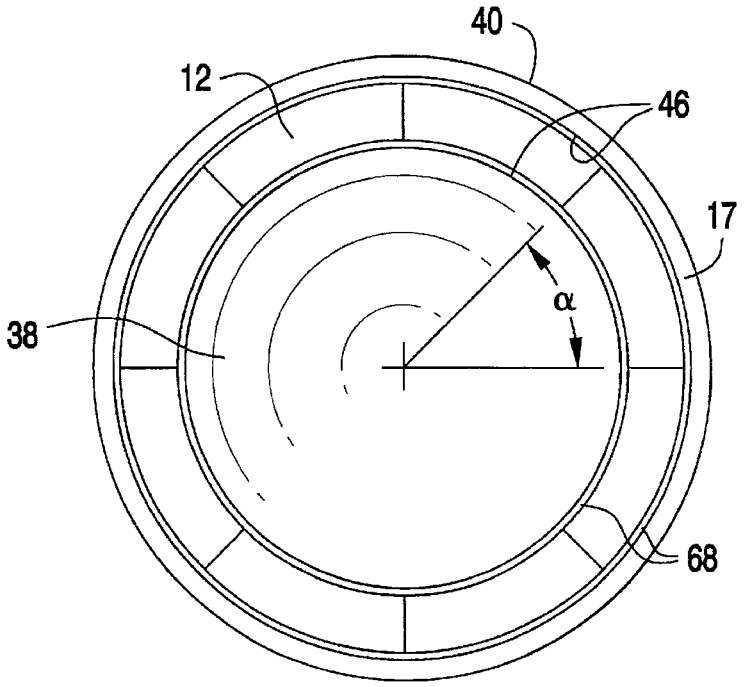
FIG. 2 is an end view of the cutter bit shown in FIG. 1.

Referring to the drawings, FIGS. 1 through 4 show one specific form of the concave cutter bit embodiment of the invention which carries the general designation 10. Concave cutter bit 10 comprises three principal parts; namely, a cutter element 12, a bit body 14, and a retainer clip 16.

The bit body 14 is generally symmetric about a central longitudinal axis A—A as shown in FIG. 1. Bit body 14 has an axially first end 18 and an axially second end 20. As will become apparent from the description, the first end 18 of the cutter bit 10 impinges upon the substrate to cut and fracture the substrate. The first end 18 could therefore be considered the impingement end of the cutter bit 10. A preferably cylindrical integral shank 22 is near the second end 20 of the bit body 14. A preferably frustoconically shaped integral head 24 is near the first end 18 of the bit body 14.

The cylindrical shank 22 preferably includes an annular groove 26 which carries the retainer clip 16. The drawings illustrate the preferred retainer clip 16, which is called dimple clip. U.S. Pat. No. 3,519,309 to Engle et al. and U.S. Pat. No. 3,752,515 to Oakes et al. each describe such a retainer clip.

It should, however, be appreciated that other retainer structures are suitable for use with the present invention. For example, a long retainer, which comprises a compressible elongate cylindrical member that is carried in a channel near the rear of the bit body, can be used with the present invention. U.S. Pat. No. 4,886,710 to Greenfield for a MINING/CONSTRUCTION TOOL BIT HAVING BIT BODY FABRICATED FROM MN-B STEEL ALLOY COMPOSITION, and U.S. Pat. No. 4,911,504 to Stiffler et al. for a CUTTER BIT AND TIP each illustrate the long retainer as applied to a point attack style of tool.

In practice, one drives the shank of the cutter bit into the bore of a holder, such as a block 28, so that the radially outwardly projecting bumps 30 of the preferred retainer clip 16 register with an annular interior groove 32 in the cylindrical bore 34 of the block 28. The concave cutter bit 10 is then free to rotate relative to the block 28.

Although the specific from of an embodiment presents a cutter bit 10 that is rotatable relative to the holder or block 28, there is no intention to limit the scope of the invention to a rotatable cutter bit. Applicant contemplates that the embodiment of the present invention encompasses non-rotatable cutter bits (i.e., a cutter bit that does not rotate relative to its holder, as well as rotatable cutter bits). In regard to the non-rotatable cutter bits, the cutter bit can be indexable so that when one portion of the cutter element or one cutter element, when a plurality of cutter elements are used, wears out one can index the cutter bit to another position relative to the holder to expose an unworn portion or cutter element for cutting.

The bit body 14 preferably contains a concavity 38 near the axially first end 18. The surface of the concavity 38 preferably defines the volume of a right cone. Other geometric shapes besides a right cone are within the scope of the embodiment of the present invention. The opening of the concavity 38 is preferably generally circular and begins at a position radially inwardly from the peripheral edge 40, and near the first end 18, of the cutter bit body 14.

The bit body 14 has a peripheral region at the periphery of the opening of the concavity 38, which preferably contains an annular channel or pocket 42 and acts as a sacrificial constraint 17. The annular channel or pocket 42 surrounds the periphery of the opening of the concave portion 38. The annular channel or pocket 42 has a transverse surface 44 and a longitudinal surfaces 46 which intersect. The transverse surface 44 is generally perpendicular to the longitudinal axis A-A of the concave cutter bit 10. The longitudinal surfaces 46 are generally parallel to the longitudinal axis A-A of the concave cutter bit 10.

Even though the annular channel or pocket 42 is the preferred way to connect the cutter element 12 to the bit body 14, there is no intention to limit the scope of the embodiment of, or for that matter, the invention to the use of a channel or a pocket. Applicant contemplates that the cutter element 12 (e.g., the segments comprising the cutter element) can be secured to a flat surface surrounding the periphery of the opening of the concavity by brazing, soldering, welding, or other means of connection. The cutter element 12 or segments of the cutter element 12 could also be received in a bore or hole contained in the peripheral region that surrounds the opening of the concavity. However, the present invention contemplates the presence of an sacrificial constraint 17 at least during the assembly of the cutter bit to facilitate improved product quality and thus product yield (i.e., the number of articles meeting the product quality criteria as a portion or percentage of the number of the articles manufactured). For example, the product yield of cutter bit bodies using the concave bit embodiment of the present invention was substantially about 100 percent. In contrast, the product yield for prior art cutter bit bodies was generally about 80 percent.

The frusto-conical head 24 preferably includes a cylindrical shoulder 36 which engages the first face 48 of the block 28 to help keep the cutter bit 10 from moving too far into the bore of the block. The portion of the frusto-conical surface that is rearward of the shoulder corresponds to, and during operation engages, the mouth 49 of the bore of the block.

There is no intention to limit the embodiment of the invention to the specific cutter bit body shown by the drawings and described herein. The cutter bit body embodiment can take on other forms and geometries such as, for example, the shank of the cutter bit can be square, pentagonal, hexagonal, heptagonal, octagonal, or for that matter acylindrical in cross-section to be held in a non-rotatable fashion by a corresponding square or acylindrical bore.

Alternatively, the shank of the cutter bit and the bore of the block can be cylindrical, but the cutter bit is still held in the block in an indexable, non-rotatable fashion. One example of this type of arrangement is to modify the rear of the shank of the cutter bit and the rear of the block to use the mechanism shown in U.S. Pat. No. 5,007,685 to Beach et al. for a TRENCHING TOOL ASSEMBLY WITH DUAL INDEXING CAPABILITY, i.e., a serrated indexing washer non-rotatably held on the shank and engaged in indentations in the rear of the block.

In the specific form of the embodiment illustrated by the drawings, the cutter element 12 preferably comprises eight separate cutter inserts, each of which carries the general designation 50. Cutter insert 50 is preferably arcuate, and has a preferred included angle "α" of about 178°, preferably 44°. Cutter insert 50 preferably has a generally flat top surface 52, a generally flat bottom surface 54, a generally arcuate exterior side surface 56, a generally arcuate interior side surface 58 and generally flat opposite end surfaces 60, 62. The surfaces of the cutter insert 50 intersect with adjacent surfaces to form relatively sharp corners. A plane defined by generally flat top surface 52 and a plane defined by generally flat bottom surface 54 can be parallel; however, an angle between the plane defined by the top surface 52 and the plane defined by the bottom surface 54 can be as large as about 30° or greater, preferably about 15° or greater for improved edge strength. It is preferable that the overall dimensions of the interior side surface 58 is smaller than that of the exterior side surface 56 so that the top surface 52, the bottom surface 54, and the end surfaces 60, 62 taper inwardly as they move toward the interior side surface 58.

The spacing between the outer diameter of cutter insert or the outer diameter defined by the plurality of cutter inserts and the corresponding diameter of the annular channel or pocket cutter of the bit body should be such as to facilitate the manufacture of the cutter bit to attain a production yield of substantially about 100 percent. Likewise, the thickness of the sacrificial constraint 17 should be such as to facilitate the manufacture of the cutter bit without failure of the sacrificial constraint during the existence of the residual stresses in the cutter elements and the sacrificial constraint. In a preferred specific form of the embodiment, the outer diameter of the cutter insert or the outer diameter defined by the plurality of cutter inserts and the corresponding diameter of the annular channel or pocket cutter of the bit body differ by less than about 3050 micrometers(120 mils), preferably about 2030 micrometers (80 mils), and more preferably about 760 micrometers (30 mils). There is no intention, however, to limit the scope of the invention to any specific dimensional spacing between the diameter of the cutter insert or the diameter defined by the plurality of cutter inserts positioned within the annular channel or pocket cutter of the first end of the cutter bit. The principal feature of the spacing is that it should be sufficiently narrow so that the sacrificial constraint constrains the cutter insert or plurality of cutter inserts during and after the solidification of the braze joint between the steel body and the cutter inserts to minimize or prevent cracks in the braze joint or the cemented tungsten carbide cutter element, or both.

Figure 3:
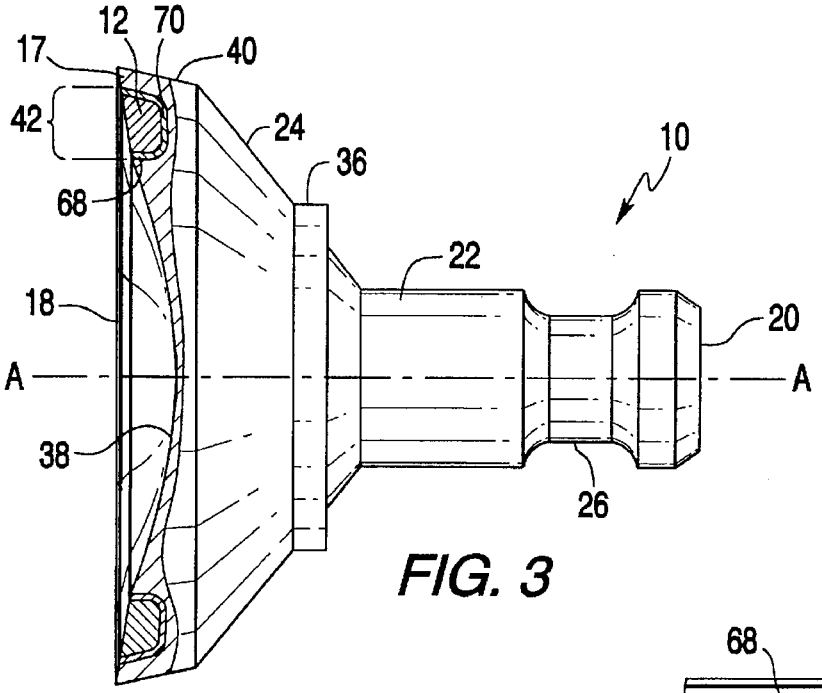
FIG. 3 is a side view of the specific embodiment FIG. 1 without the retainer clip, and with a portion of the bit body shown in cross-section so as to illustrate he connection between the cutter inserts and the bit body.
Figure 3A:
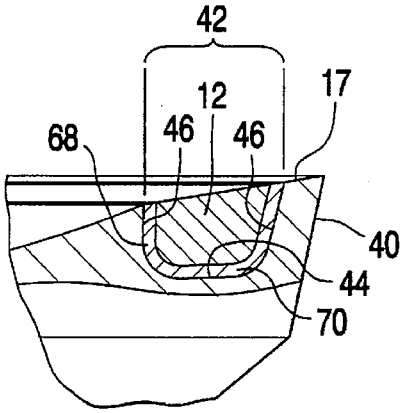
FIG. 3A is an enlarged view of a portion of the cutter bit with a portion shown in cross-section so as to illustrate the braze joints between the cutter insert and the bit body.
Figure 4:
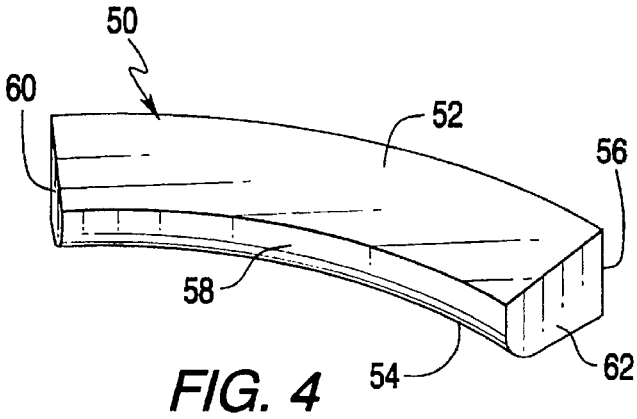
FIG. 4 is a perspective view of the cutter insert of FIG 1.

Referring to FIG. 3A, a braze joint 68 exists between the interior side surface 58 of insert 50 and the longitudinal surface 46 of the channel 42. A braze joint 70 exists between the bottom surface 54 of each cutter insert 50 and the transverse surface 44 of the channel.

Figure 5:
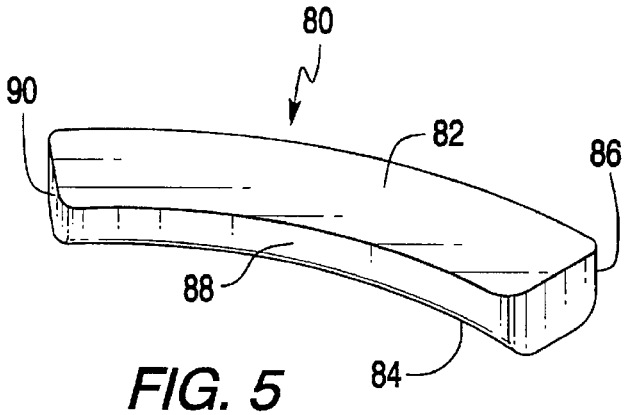
FIG. 5 is a perspective view of a modified cutter insert for use With a concave cutter bit body like that of FIG. 1.

Referring to FIG. 5, there is illustrated an alternate style of cutter insert generally designated as 80. Cutter insert 80 is preferably generally arcuate in shape, and has a preferred included angle like that of cutter insert 50. Cutter insert 80 preferably has a generally flat top surface 82, a generally flat bottom surface 84, a generally arcuate exterior side surface 86, a generally arcuate interior side surface 88 and generally flat opposite end surfaces 90, 92. The intersection of the surfaces of the cutter insert 80 are preferably rounded off.

Cutter insert 80 is positioned within the channel 42 of the cutter bit 10 in a fashion like that for cutter insert 50. The presence of the gaps and positioning of the cutter inserts 80 in a spaced-apart relationship is same as that for cutter insert 50.

While other hard materials, such as, cermets, ceramics, and ceramic and/or metal composite materials, can be acceptable, a preferred material comprises cobalt-based cemented tungsten carbide and more preferably a grade of cobalt-based cemented tungsten carbide for the cutter inserts 50 and 80 is a composition comprising about 90.5 weight percent large grain tungsten carbide and about 9.5 weight percent cobalt.

While other braze alloys can be acceptable, a preferred braze alloy for the cutter bit 10 is a silver-based braze alloy having the following composition: about 50 weight percent silver, about 20 weight percent copper, about 28 weight percent zinc, and about 2 weight percent nickel. The preferred braze alloy has a solidus of about 1220° C. and a liquidus of about 1305° C. This braze alloy is known by the American Welding Society (A5.8) specification BAg-4 A-50N. This preferred braze alloy is sold by Handy & Harman as Braze 505.

Although the present invention has been described in considerable detail with reference to certain preferred versions thereof, other versions are possible and will be apparent to those skilled in the art from a consideration of this specification or practice of the invention presently disclosed.

For example, the sacrificial constraint might also be used in connection with conical bit such as that disclosed in U.S. Pat. No. 4,725,098 issued in the name of Beach. In such an example, the hard facing material might be replaced by, for example, an annular ring or collar which fits into a annular groove or channel defined by an extended portion. As the inventor contemplates for the concave cutter bit embodiment, the extended portion is sacrificial in use. That is, the extended portion wears during use to expose the annular ring or collar which imparts superior wear resistance to periphery of the conical bit.

In another embodiment of the present invention, the sacrificial constraint can be used in connection with conical bit such as that disclosed in U.S. Pat. No. 5,417,475 issued in the name of Graham et al. In such an example, the retaining member might be placed in, for example, an annular ring or collar which fits into a annular groove or channel define by a sacrificial constraint. The sacrificial constraint wears during use to exposed the annular ring or collar which imparts superior wear resistance to periphery of the conical bit by reducing wear around an inner insert.

Therefore, the spirit and scope of the appended claims should not be limited to the description of the preferred versions contained herein.

Other specific embodiments of the invention will be apparent to those skilled in the art from a consideration of this specification or practice of the disclosed invention. It is intended that the specification, the specific form of the concave bit embodiment, and the other embodiments be considered as exemplary only, with the true scope and spirit of the invention being indicated by the following claims.

All patents and documents referred to by this patent application are hereby incorporated by reference herein.

What is claimed is:

1. A cutter bit comprising:

a bit body having a first end, a second end, the second end opposite the first end, a concavity in the first end, a sacrificial constraint at the first end, an annular channel or pocket defined by a first surface at the periphery of the concavity, a second surface radially outward form the first surface and radially inward from the sacrificial constraint of the first end, and a transverse surface extending therebetween; and at least one cutter insert secured by a binding material to the bit body at the periphery of the concavity and within the annular channel or pocket.

2. The cutter bit of claim 1, wherein the cutter bit is rotatable.

3. The cutter bit of claim 1, where in the at least one insert comprises a plurality of cutter inserts, each of the cutter inserts being generally arcuate.

4. The cutter bit of claim 3, wherein each one of the cutter inserts has an included angle of at least about 178 degrees.

5. The cutter bit of claim 1, wherein each one of the cutter inserts is made of cobalt-based cemented tungsten carbide, and the bit body is made from steel.

6. The cutter bit of claim 5, wherein the cobalt-based cemented tungsten carbide comprises about 90.5 weight percent tungsten carbide and about 9.5 weight percent cobalt.

7. The cutter bit of claim 1, wherein the binder material comprises a braze alloy comprising about 50 weight percent silver, about 20 weight percent copper, about 28 weight percent zinc, and about 2 weight percent nickel.

8. The cutter bit of claim 1, wherein the bit body comprises a generally cylindrical shank near the second end thereof, the shank containing a groove therein, and the groove in the shank carrying retainer.

9. A cutter bit-block assembly comprising:

a block containing a bore therein; and a cutter bit having a bit body having a first end, a second end opposite the first end, a concavity in the first end, a sacrificial constraint at the first end, an annular channel or pocket defined by a first surface at the periphery of the concavity, a second surface radially outward form the first surface and radially inward from the sacrificial constraint at the first end, and a transverse surface therebetween;

at least one cutter insert secured by a binder material to the bit body at the periphery of the concavity and within the annular channel or pocket; and a retainer that engages the bore of the block to retain the cutter bit to the block.

10. The cutter bit-block assembly of claim 9, wherein the at least one insert comprises a plurality of cutter inserts, each of the cutter inserts being generally arcuate.

11. The cutter bit-block assembly of claim 9, wherein each one of the cutter inserts has an included angle of at least about 178 degrees.

12. The cutter bit-block assembly of claim 9, wherein each one of the cutter inserts is made of cobalt-based cemented tungsten carbide, and the bit body is made from steel.

13. The cutter bit-block assembly of claim 9, wherein the cobalt-based cemented tungsten carbide comprises about 90.5 weight percent tungsten carbide and about 9.5 weight percent cobalt.

14. The cutter bit-block assembly of claim 9, wherein the bonding material comprises a braze alloy comprising about 50 weight percent silver, about 20 weight percent copper, about 28 weight percent zinc, and about 2 weight percent nickel.

15. The cutter bit-block assembly of claim 9, wherein the bit body comprises a generally cylindrical shank near the second end thereof, the shank containing a groove therein, and the groove in the shank carrying retainer.

16. The cutter bit-block assembly of claim 9 wherein cutter bit is rotatable with respect to the block.

17. A cutter bit for impinging a substrate, the cutter bit comprising:

an elongate bit body having an impingement end, a sacrificial constraint adjacent to the impingement end, and at least one insert connected to the bit body at the sacrificial constraint, wherein the bit body contains a cavity at the impingement end thereof, and the cavity has an open end defined by the sacrificial constraint.

18. The cutter bit of claim 17, wherein the cavity is concave in shape.

19. The cutter bit of claim 18, wherein the sacrificial constraint includes a transverse surface generally perpendicular to the longitudinal axis of the bit body, and the at least one cutter insert being connected to the transverse surface.

20. The cutter bit of claim 17, wherein the sacrificial constraint further includes a longitudinal surface generally parallel to the longitudinal axis of the bit body, and the at least one insert being connected to the longitudinal surface.

21. The cutter bit of claim 17 further comprising a retaining member around a second inner insert at the impingement end of the elongated body.

22. The cutter bit of claim 17 further comprising a annular ring or collar spaced axially from the impingement end and further comprising a second insert at the impingement end of the elongated body.

* * * * *